US005561863A

United States Patent [19]

Carlson, II

[11] Patent Number: 5,561,863

[45] Date of Patent: Oct. 8, 1996

[54] SURGICAL FACE MASK

[75] Inventor: Gerald I. Carlson, II, Marietta, Ga.

[73] Assignee: Kimberly-Clark Corporation, Neenah, Wis.

[21] Appl. No.: 317,954

[22] Filed: Oct. 4, 1994

[51] Int. Cl.[6] ..... A62B 18/02

[52] U.S. Cl. ..... 2/206; 128/206.19; 128/863

[58] Field of Search ..... 2/206, 9, 173, 2/7; 128/206.19, 863

[56] References Cited

U.S. PATENT DOCUMENTS

| | | | |
|---|---|---|---|
| Re. 28,102 | 8/1974 | Mayhew | 128/146.2 |
| D. 319,111 | 8/1991 | Sandel et al. | D29/9 |
| 1,800,051 | 4/1931 | Blanco | 128/201 |
| 4,296,746 | 10/1991 | Mason, Jr. et al. | 128/201.15 |
| 4,323,063 | 4/1982 | Fisichella | 128/863 |
| 4,467,799 | 8/1984 | Steinberg | 128/206.19 X |
| 4,583,535 | 4/1986 | Saffo | 2/7 X |
| 4,628,927 | 12/1986 | Ward | 128/206.17 |
| 4,641,645 | 2/1987 | Tayebi | 128/206.19 |
| 4,653,124 | 3/1987 | McNeal et al. | 128/201 |
| 4,662,005 | 5/1987 | Grier-Idris | 2/9 |
| 4,796,621 | 1/1989 | Barle et al. | 128/206 |
| 4,821,340 | 4/1989 | Johnson | 2/9 |
| 4,901,716 | 2/1990 | Stackhouse et al. | 128/201.15 |
| 4,920,960 | 5/1990 | Hubbard et al. | 128/206.12 |
| 4,944,294 | 7/1990 | Borek, Jr. | 128/206.19 |
| 4,966,140 | 10/1990 | Herzberg | 128/206.19 |
| 5,067,174 | 11/1991 | Ritchey et al. | 128/206.19 X |
| 5,107,547 | 4/1992 | Scheu | 02/206 |
| 5,150,703 | 9/1992 | Hubbard et al. | 128/206.12 |

FOREIGN PATENT DOCUMENTS

| | | | |
|---|---|---|---|
| 85746 | 2/1982 | European Pat. Off. | 128/201.17 |
| 0242988 | 10/1987 | European Pat. Off. | A61F 9/02 |
| 391726 | 10/1990 | European Pat. Off. | 128/136 |
| 2129670 | 5/1984 | United Kingdom | A62B 17/04 |
| WO89/10106 | 11/1989 | WIPO | 128/201 |

OTHER PUBLICATIONS

Webster's II, *New Riverside University Dictionary*, 1984, p. 897.

*Primary Examiner*—Peter Nerbun
*Attorney, Agent, or Firm*—David J. Alexander

[57] ABSTRACT

A surgical face mask having a see-through portion and a porous portion wherein the see-through portion is adapted for viewing a portion of the wearer's mouth. The face mask may further include an eye shield which may be pivotally secured thereto. The see-through portion may be formed from a fog-resistant flexible film. The porous portion may be formed from a spunbond/meltblown nonwoven laminate.

22 Claims, 3 Drawing Sheets

SURGICAL FACE MASK

FIELD OF INVENTION

The present invention relates to face masks and more particularly, to surgical face masks.

BACKGROUND OF INVENTION

Face masks and particularly surgical face masks are, in general, designed to filter air born contaminates from the gases which are inhaled and exhaled by the wearer. In surgical procedures, such air born contaminates include, but are not limited to, biological contaminates, such as bacteria, viruses, fungal spores, lint, mineral fines, dust, skin squames and respiratory droplets. In this way, the surgical personnel, and particularly the respiratory systems of surgical personnel, are not contaminated by such contaminates, and particularly such contaminates originating from the patient and/or other surgical personnel. Nor is the patient, and particularly the operative site of the patient, contaminated by such contaminates.

To adequately filter or segregate such air born contaminates, conventional surgical face masks are generally constructed to satisfy several criteria. In an effort to meet some of these criteria, face mask manufactures have employed such things as suitable air born contaminate filter medium and provided structures which form a substantially gas-tight fit about the nose and mouth of the wearer. Additionally, face mask manufactures have also been concerned with minimizing condensation of moisture within the mask, and providing a comfortable and easily donable product. To these ends, traditional surgical face masks have been constructed such that the air born contaminate filter medium overlies the wearer's nose and mouth. As such, the filter medium prevents the patient from seeing the portions of the wearer's face covered by such surgical face masks. Accordingly, visual communications in the form of facial expressions between the wearer and the patient and/or other surgical personnel are impaired by such surgical face masks. This is so because the wearer's lip movements and or facial expression defined by the mouth and areas adjacent thereto are blocked when wearing such a surgical face mask. These deficiencies are even more pronounced if the wearer is in the presence of a hearing impaired individual.

Therefore, there exists a need to not only provide a surgical face mask which effectively segregates air born contaminates but also provides for improved communication between surgical personnel and the patient. Such an improved surgical face mask is provided by the present invention and will become more apparent upon further review of the following specification and claims.

SUMMARY OF THE INVENTION

In response to the above problems encountered by those of skill in the art, the present invention provides a face mask formed from a porous portion and a see-through portion secured to the porous portion. The see-through portion is adapted for overlying a portion of at least one and desirably both of the wearer's lips. The see-through portion may be formed, for example, from a flexible, fog-resistance, non-glare film or other clear material such as plastic sheets, plexiglass, etc. The porous portion may be formed from a nonwoven, polyolefin based, fabric. In one embodiment, the face mask may further include an eye shield. The eye shield may be pivotally secured to the face mask.

In another embodiment, the face mask may include at least two porous portions separated by and secured to the see-through portion. The see-through portion may further be formed from a pair of spaced apart see-through films.

DETAILED DESCRIPTION

Several terms may be used herein to refer to affixing the one or more structures of the face mask of the present invention to another structure of the face mask of the present invention These terms include "join","secure", "attach" and derivatives and synonyms thereof. The affixing of such structure(s) of the present invention to another structure(s) may be accomplished by any of several conventional methods. By way of example and not limitation, these methods include stitching, gluing, heat sealing, zipping, snapping, sonic or thermal bonding or using a hook and loop fastening system and other methods familiar to those skilled in the art.

The term "see-through" or "see-through portion" means a structure formed from a material which permits a sufficient amount of visible light having wavelengths within the range of about 3900 angstroms to about 7700 angstroms to pass therethrough such that a viewer on one side of such material may discern an object or a feature of an object on the other side of and in close proximity to such material. Such material desirably is transparent. However, in some embodiments, it is envisioned that the "see-through" material may be translucent, tinted, frosted or any combination thereof.

Figure 1:
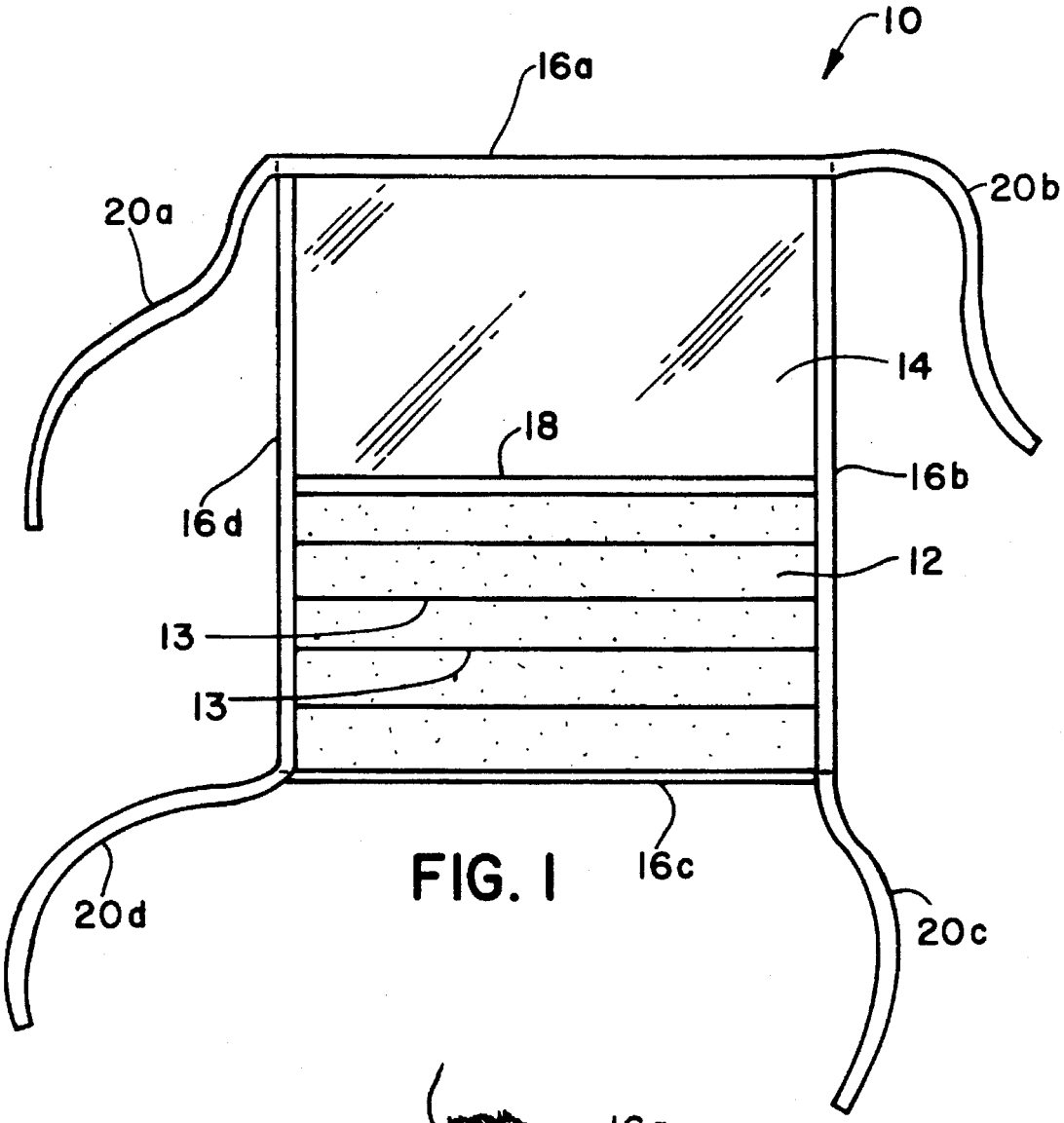
FIG. 1 is a plan view of the face mask of the present invention.

Turning now to the drawings and referring first to FIG. 1, one embodiment of the surgical face mask 10 of the present invention is illustrated. The face mask 10 includes a porous portion 12, having pleats 13, for filtering air born contaminates.

The porous portion 12 may be formed from filtration materials which may be rigid, pre-molded, or flexible. In one embodiment, the porous portion 12 may be formed from a flexible fabric laminate of layers of a nonwoven material. The flexible fabric laminate is sufficiently porous to preform as a suitable contaminate barrier while permitting the wearer to easily breath therethrough. It has been found that nonwoven webs formed from polyolefin-based fibers are particularly well-suited for use as a filtration material in the present invention. Examples of such nonwoven webs are the polypropylene nonwovens produced by the Assignee of record, Kimberly-Clark Corporation. One such multiple-layered nonwoven web, a spunbond, meltblown, spunbond (SMS) nonwoven web, is produced by Kimberly-Clark Corporation.

This spunbond, meltblown, spunbond web may be made from three separate layers which are laminated to one another. Such a method of making this laminated web is described in commonly assigned U.S. Pat. No. 4,041,203 to Brock et al which is incorporated herein in its entirety by reference. Alteratively, the spunbond, meltblown, spunbond web may be made by first forming a spunbond-meltblown laminate. The spunbond-meltblown laminate is formed by applying a layer of meltblown on to a layer of spunbond. The second layer of spunbond is then applied to the meltblown side of the previously formed spunbond-meltblown laminate. Generally, the two outer layers provide the nonwoven web with strength while the inner layer provides barrier properties.

Secured to the porous portion 12 is a see-through portion 14. Materials suitable for forming the see-through portion 14, include, but are not limited to, non-fogging or fog-resistant materials and/or non-glare or reduce-glare materials. Examples of such materials include, but are not limited to, films such as polyethylene, polyvinyl alcohol, polypropylene, polycarbonate, plastic sheets, plexiglass and glass. Such material may further be ridged, flexible, or pre-molded. Additionally, a non-fogging or fog-resistant coating may be applied to such materials. Examples of suitable non-fogging or fog-resistant coatings include, but are not limited to, silicone coatings and floro-chemical coatings.

Generally, at the edges of the face mask 10 are provided with formable sealing structures 16 *a–d* for conformally fitting the edges of the mask 10 to the facial features of the wearer such that a substantially gas-tight seal between the mask and the face of the wearer is created. The formable sealing structures 16 *a–d* are secured to the respective edge portions of the porous portion 12 and the see-through portion 14. The structures 16 *a–d* may be formed from a variety of materials and material combinations which can be physically deformed so as to conform to the surface contours of the wearer's face. These materials include, but are not limited to (i) elastic members overlaid by a material suitable for forming a substantially gas-tight seal between the mask and the wearer's face, (ii) thin strips of bendable or deformable material, such as aluminum or thin gauge steel overlaid by a material suitable for forming a substantially gas-tight seal between the mask and the wearer's face, or (iii) combinations thereof. Materials suitable for forming a substantially gas-tight seal between the mask and the wearer's face include folded strips of elastic or porous material, foamed plastics, adhesives and adhesive films or combinations thereof. Additionally, a formable structure 18 may be incorporated at or adjacent to the intersection of the porous portion 12 and the see-through portion 14. The formable the structure 18 may also be similar to and formed from materials used for forming the formable sealing structures 16 *a–d*.

Fasteners, such as ties 20 *a–d*, are provided to secure the face mask 10 to the head of the wearer. Suitable fasteners include ties 20 *a–d* or may include one-piece elastic strips (not shown) for encircling the wearer's head or ears.

Other suitable filtration materials, formable sealing structures and structures for securing the mask to the head of the wearer are disclosed in U.S. Pat. Nos. 5,150,703, 4,944,294, 4,796,621, 5,107,547, 4,966,140, 4,662,005, 4,641,645, 4,628,927, and Re.28,102 which are incorporated herein in their entirety by reference.

Figure 1A:
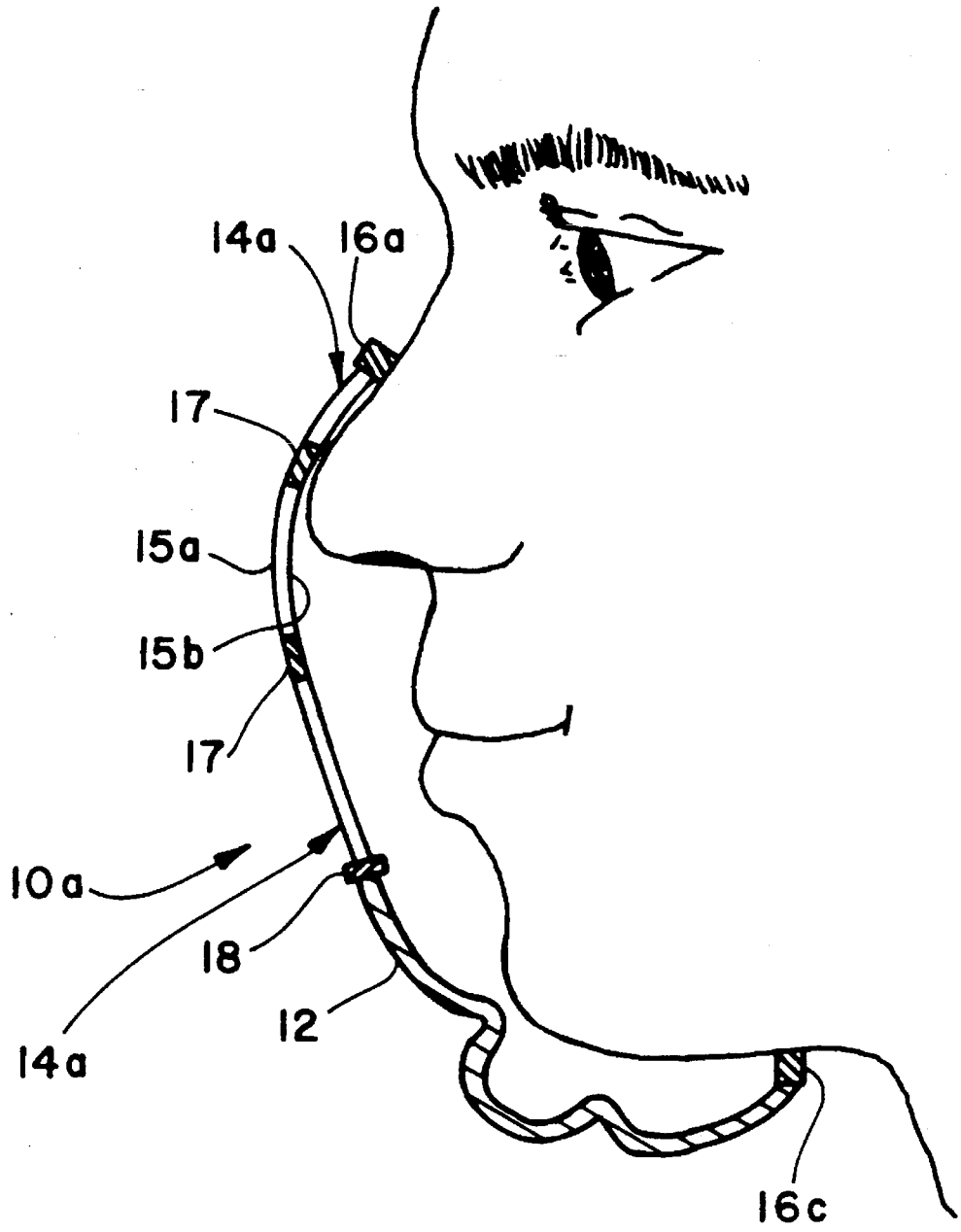
FIG. 1A is a cross-sectional view of another embodiment of the face mask of FIG. 1 as worn.

Referring now to FIG. 1A, a see-through portion 14*a* of the face mask 10*a*, illustrated in cross-section, may be formed form a plurality of spaced apart materials and particularly a pair of spaced apart films and more particularly a pair of spaced apart plastic sheets or plexiglass, such as an outer film 15*a* and an inner film 15*b*. The films 15*a* and 15*b* may be secured together along all or a portion of their respective edges so as to create an area therebetween of reduced air movement.

The spacing between films 15*a* and 15*b* may be maintained by positioning one or more spacers 17 a sufficient distance from other spacers 17 and or adjacent formable structures 16 a, b and d and 18. The spacers 17 may also be formed from see-through material. By separating the films 15*a* and 15*b* a sufficient distance apart and creating an area of reduced air movement therebetween, the formation of condensation within the mask 10*a*, and particularly fogging on the film 15*b* may be reduced.

The see-through portion 14*a* is of sufficient size and is secured to the porous portion 12 so as to permit viewing of at least a portion of at least one and desirably both of the wearer's lips. The porous portion 12 is positioned below the wearer's mouth and generally captures the wearer's chin.

Figure 2:
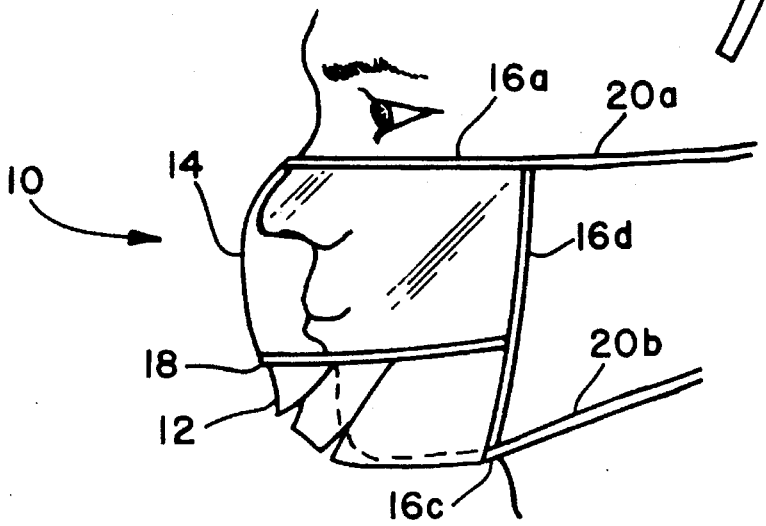
FIG. 2 is a side view of the face mask illustrated in FIG. 1 as worn.
Figure 3:
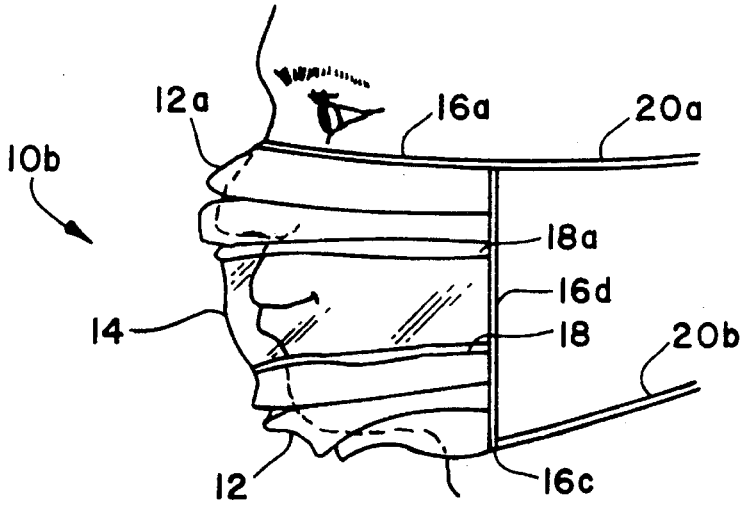
FIG. 3 is a side view of another embodiment of the face mask of the present invention as worn.

Referring now to FIGS. 2 and 3, the see-through portion 14 of the surgical face mask 10 is of sufficient size and is secured to the porous portion 12 so as to permit viewing of at least a portion of at least one and desirably both of the wearer's lips. In some embodiments the see-through portion 14a may cover substantially all of the area of the face mask 10 with the porous material being located beneath the chin or below the ears of the wearer. In FIG. 2, the porous portion 12 is positioned below the wearer's mouth and generally captures the wearer's chin. The see-through portion 14 is of sufficient size to overlie the wearer's mouth and nose and areas of the wearer's face adjacent thereto. In this way, exhalations are directed downwardly and generally perpendicular to the object or person in face to face orientation with the wearer. In this same way, air entering the mask upon the wearer's inhalations is drawn generally from axis which are downward and perpendicular to the object or person in face to face orientation with the wearer.

With reference now to FIG. 3, the surgical face mask 10b is similar to the surgical face mask 10 illustrated in FIG. 2 except that surgical face mask 10b includes a second porous portion 12a secured to the upper edge of the see-through portion 14. "The see-through portion may also be formed from a pair of spaced apart films". The porous portion 12*a* is of sufficient size to overlie the nose of the wearer. Furthermore, a formable sealing structure 18*a* may be secured at the intersection of the porous portion 12*a* and the see-through portion 14.

Figure 4:
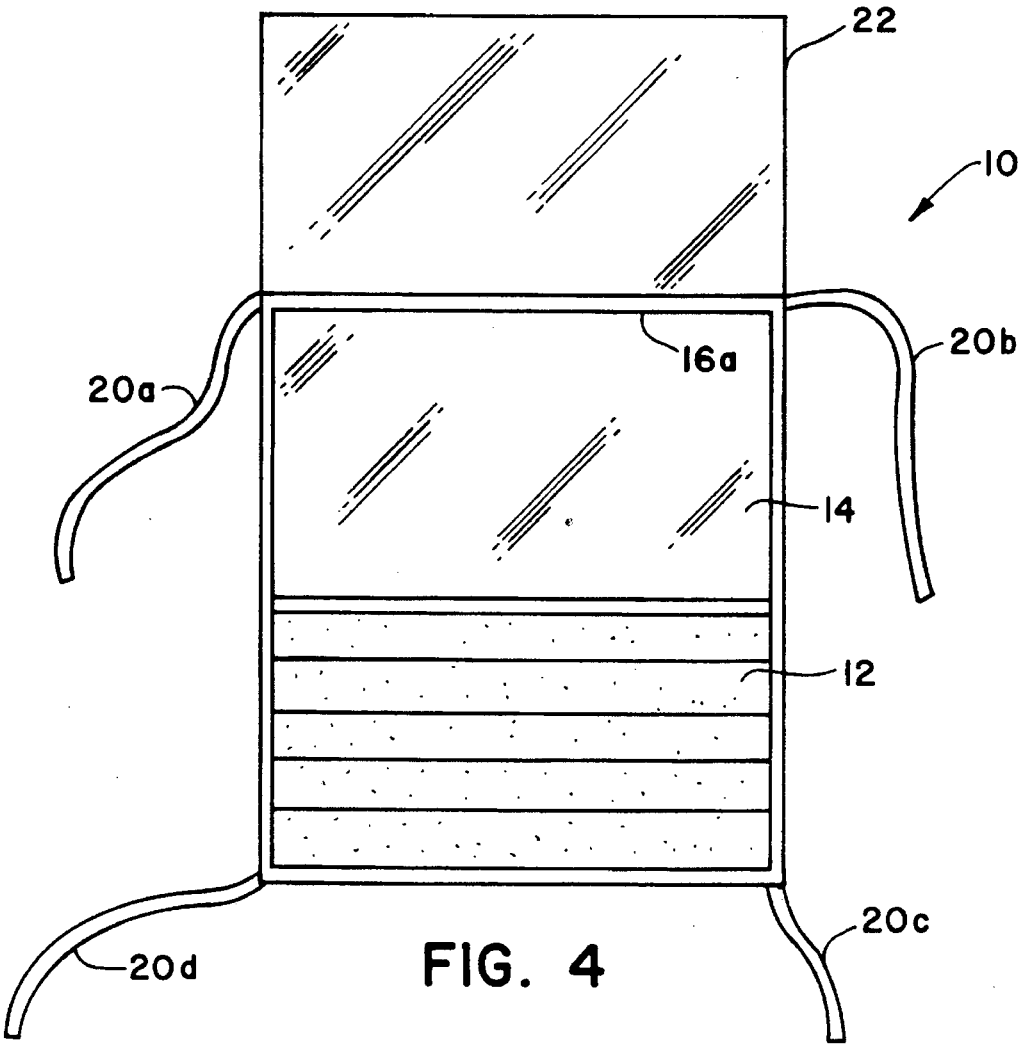
FIG. 4 is a plan view of the face mask illustrated in FIG. 1 further including an eye shield.

Turning now to FIG. 4, the surgical face mask 10 is further provided with an eye shield 22. The eye shield 22 may be formed for either flexible or rigid see-through film or may be formed from film suitable for forming the see-through portion 14. The eye shield 22 may be detachably secured to the face mask 10, permanently secured to the face mask 10, pivotally secured to the face mask 10 or any combination thereof. While the invention has been described in detail with respect to specific embodiments thereof, it will be appreciated that those skilled in the art, upon attaining an understanding of the foregoing, may readily conceive of alterations to, variations of and equivalents to these embodiments. For example, the mask 10 may be formed to extend substantially around the wearer's head with the porous portion being located at the back of the wearer's head or neck. Accordingly, the scope of the present invention should be assessed as that of the appended claims and any equivalents thereto.

What is claimed is:

1. A face mask comprising:

at least two fibrous porous portions separated by and secured to a film see-through portion, wherein the film see-through portion is formed from a pair of spaced apart flexible films.

2. The face mask of claim 1 further including fasteners for securing the face mask to the wearer's head.

3. The face mask of claim 1 wherein at least one of the fibrous porous portions is formed from a flexible fabric.

4. The face mask of claim 1 further including an eye shield secured to the film see-through portion.

5. The face mask of claim 4 wherein the eye shield is pivotally secured to the face mask.

6. The face mask of claim 1 wherein the film see-through portion is adapted for overlying a portion of at least one of the wearer's lips.

7. The face mask of claim 1 wherein at least one of the fibrous porous portions is formed from at least two layers of polyolefin fibers, wherein the one of the layers is formed by spunbonding and another layer is formed by meltblowing.

8. The face mask of claim 1 wherein gases exiting at least one of the fibrous porous portions are directed generally perpendicular to an object or a person in face to face orientation to the wearer.

9. The face mask of claim 1 wherein gases entering the face mask through at least on of the fibrous porous portions are drawn generally from an axis which is downward and perpendicular to an object or person in face to face orientation with a wearer of the face mask.

10. The face mask of claim 1 wherein exhalation gases exiting at least one of the fibrous porous portions are directed downwardly by the see-through portion.

11. The face mask of claim 1 wherein at least one of the flexible films is formed from a material selected from the group which includes polyethylene, polyvinyl alcohol, polypropylene, polycarbonate, plastic sheets, plexiglass and glass.

12. A face mask comprising:

a fibrous porous portion; and a film see-through portion secured to the fibrous porous portion, wherein the film see-through portion is formed from a pair of spaced apart flexible films.

13. The face mask of claim 12 further including fasteners for securing the face mask to the wearer's head.

14. The face mask of claim 12 wherein the fibrous porous portion is formed from a flexible fabric.

15. The face mask of claim 12 further including an eye shield secured to the film see-through portion.

16. The face mask of claim 15 wherein the eye shield is pivotally secured to the face mask.

17. The face mask of claim 12 wherein the film see-through portion is adapted for overlying a portion of at least one of the wearer's lips.

18. The face mask of claim 12 wherein the fibrous porous portion is formed from at least two layers of polyolefin fibers, wherein the one of the layers is formed by spunbonding and another layer is formed by meltblowing.

19. The face mask of claim 12 wherein gases exiting the fibrous porous portion are directed generally perpendicular to an object or a person in face to face orientation to the wearer.

20. The face mask of claim 12 wherein gases entering the face mask through the fibrous porous portion are drawn generally from an axis which is downward and perpendicular to an object or person in face to face orientation with a wearer of the face mask.

21. The face mask of claim 12 wherein exhalation gases exiting the fibrous porous portion are directed downwardly by the see-through portion.

22. The face mask of claim 12 wherein at least one of the flexible films is formed from a material selected from the group which includes polyethylene, polyvinyl alcohol, polypropylene, polycarbonate, plastic sheets, plexiglass and glass.

* * * * *